US007597126B2

(12) United States Patent
Chen

(10) Patent No.: US 7,597,126 B2
(45) **Date of Patent: *Oct. 6, 2009**

(54) GOLF CLUB HEAD COVER

(75) Inventor: Xiaojian Chen, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 440 days.

This patent is subject to a terminal disclaimer.

(21) Appl. No.: 11/193,098

(22) Filed: Jul. 29, 2005

(65) Prior Publication Data

US 2007/0023116 A1 Feb. 1, 2007

(51) Int. Cl.
*B65D 65/02* (2006.01)

(52) U.S. Cl. ..... 150/160; 206/818

(58) Field of Classification Search ..... 150/160; 206/818

See application file for complete search history.

(56) References Cited

U.S. PATENT DOCUMENTS

| | | | | | |
|---|---|---|---|---|---|
| 3,133,577 | A | * | 5/1964 | Bellevue, Sr. | 150/160 |
| D202,200 | S | * | 9/1965 | Bates | D21/754 |
| 3,861,434 | A | * | 1/1975 | Harding | 150/160 |
| 3,938,570 | A | * | 2/1976 | Stewart | 150/160 |
| 4,667,716 | A | | 5/1987 | Solheim | |
| 5,005,624 | A | | 4/1991 | Sung | |
| 5,146,968 | A | * | 9/1992 | Meek | 150/160 |
| 5,437,320 | A | | 8/1995 | Sung | |
| 6,095,214 | A | | 8/2000 | Gaffney | |
| 6,119,742 | A | | 9/2000 | Maeng | |
| 6,202,723 | B1 | | 3/2001 | Maeng | |
| D444,525 | S | * | 7/2001 | Bernath | D21/754 |
| D447,202 | S | * | 8/2001 | Besnard et al. | D21/754 |
| 6,321,805 | B1 | | 11/2001 | Suggs | |
| D535,344 | S | * | 1/2007 | Chen | D21/754 |
| 2005/0016648 | A1 | * | 1/2005 | Vakharia et al. | 150/160 |

FOREIGN PATENT DOCUMENTS

| | | | |
|---|---|---|---|
| GB | 2327363 | | 1/1999 |
| JP | 2003-225335 | A * | 8/2003 |
| JP | 2003-265662 | A * | 9/2003 |

* cited by examiner

*Primary Examiner*—Tri M Mai

(57) ABSTRACT

A golf club head cover includes a bottom wall and a pair of side walls extending from the bottom wall to form a compartment for containing a golf club head. The side walls also define an opening through which the club head may be inserted into and removed from the compartment. Magnets secured in the bottom wall hold the head cover on the club head when the club head is contained in the compartment. Since the head cover is held on the club head by magnetic force, no other fastening devices are needed to prevent the head cover from being inadvertently removed from the club head.

14 Claims, 1 Drawing Sheet

GOLF CLUB HEAD COVER

BACKGROUND OF THE INVENTION

The present invention relates generally to golf equipment and, in particular, to a golf club head cover.

Proper care of golf clubs is required both to maximize their usable life and to maintain their performance. An important aspect of proper care includes protecting golf club heads from damage due to impact with other golf club heads or exposure to environmental elements when not in use. Thus, head covers are widely used for certain types of golf clubs such as putters and woods. However, many prior head covers have used either no fastening devices or fastening devices that malfunction thereby hindering their effective use and/or discouraging their frequent use.

SUMMARY OF THE INVENTION

The present invention provides a golf club head cover including a body having a bottom wall and a pair of side walls extending from the bottom wall to form a compartment for containing a golf club head. The side walls also define an opening through which the club head may be inserted into and removed from the compartment. Magnetic means on the head cover hold it on the club head when the club head is contained in the compartment. In the preferred embodiment, the magnetic means comprises a magnet located adjacent a heel end of the body and another magnet located adjacent a toe end of the body. Theses magnets are preferably secured in the bottom wall.

DESCRIPTION OF THE INVENTION

Figure 1:
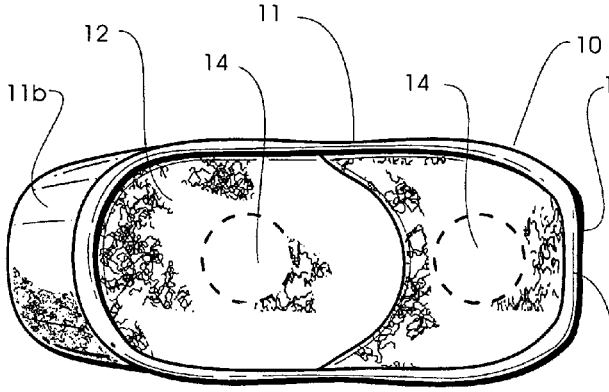
FIG. 1 is a top view of a golf club head cover in accordance with the present invention.
Figure 3:
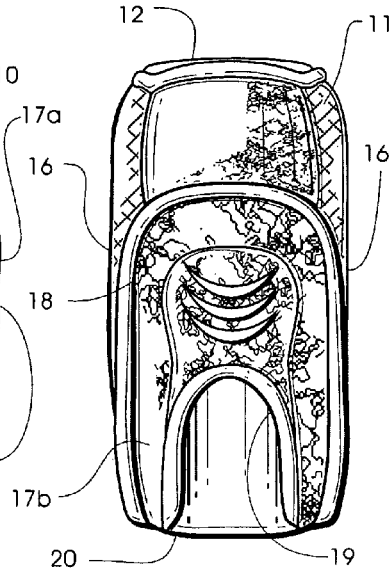
FIG. 3 is an end view of the golf club head cover of FIG. 1.
Figure 2:
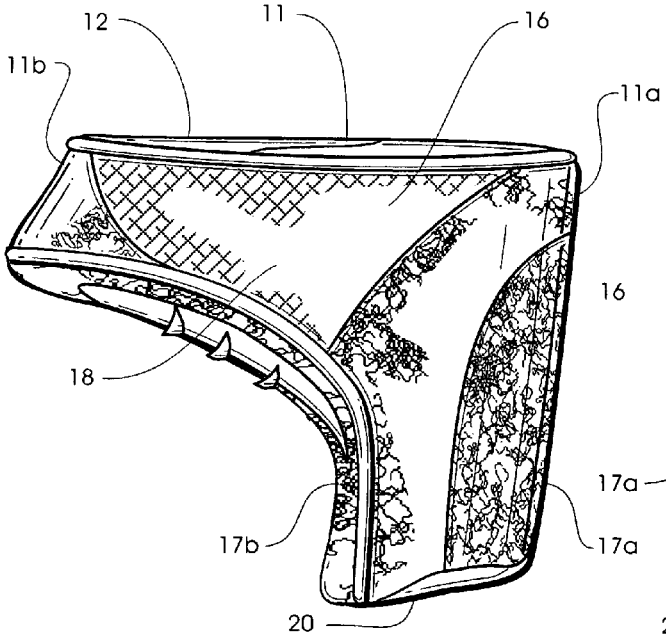
FIG. 2 is a side view of the golf club head cover of FIG. 1.
Figure 4:
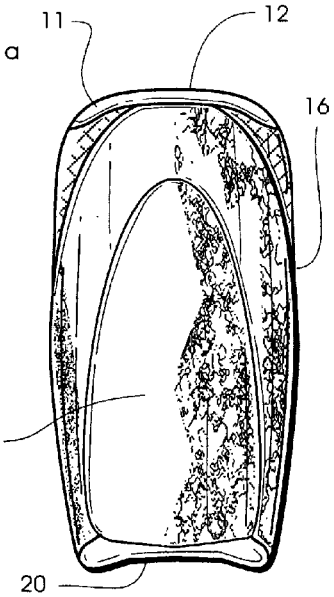
FIG. 4 is an opposite end view of the golf club head cover of FIG. 1.

Referring to FIGS. 1 and 2, a golf club head cover 10 is sized and shaped to fit on a golf club head (not shown). The head cover 10 includes a body 11 having a bottom wall 12 with magnetic means, such as a plurality of magnets 14, secured (i.e. embedded) in the bottom wall 12. The head cover 10 also includes a pair of side walls 16 which extend from the bottom wall 12 to form a compartment 18 for containing a golf club head. The magnets 14 hold the head cover 10 on the club head when the club head is contained in the compartment 18. The side walls 16 also define an opening 20 through which the club head may be inserted into or removed from the compartment 18. The opening 20 is further defined by a pair of end walls 17*a*, 17*b* extending between the side walls 16. One of the end walls 17*b* is located closer to a toe end l1*b* of the body 11 than a heel end 11*a* of the body 11. The end wall 17*b* has a substantially U-shaped opening 19 formed therein.

The bottom wall 12 and the side walls 16 may be formed from a variety of materials, such as leather, synthetic rubber, neoprene, polyethylene, polyurethane, ABS or other plastic or fabric materials. The magnets 14 facilitate use of the head cover 10 without undue manipulation thereby promoting frequent use of the head cover 10. Since the head cover 10 is held on the club head by magnetic force, no other fastening devices are needed to prevent the head cover 10 from being inadvertently removed from the club head.

In the preferred embodiment, the two magnets 14 are generally cylindrical with a thickness of about 3 mm and a diameter of about 20 mm. One magnet 14 is located adjacent the heel end 11*a* of the body 11 while the other magnet 14 is located adjacent the toe end 11*b* of the body 11. Each magnet 14 may be held in place in the bottom wall 12 by adhesives, rivets, stitching, or other conventional means. Alternatively, magnetic means of different sizes and shapes may be used instead of the magnets 14. For example, a strip of magnetic material (not shown) extending longitudinally of the bottom wall 12 may be used.

In the preferred embodiment, the head cover 10 is a putter head cover for use on a golf putter head. In other embodiments, the head cover 10 may be configured to accommodate other types of club heads such as wood heads and iron heads.

It will be understood that the magnets 14 could be secured in one or both of the side walls 16 instead of in the bottom wall 12. Also, it will be understood that the magnetic force of the magnets 14 permits a golfer to use a golf club to easily retrieve the head cover 10 without bending over.

What is claimed is:

1. A golf club head cover comprising:

a body having an elongated bottom wall, a pair of side walls, a heel end and a toe end, said side walls each lying at a generally right angle to said bottom wall;

the side walls extending from the bottom wall to form a generally L-shaped compartment for containing a golf club head and to define an opening adjacent the body heel end through which the club head may be inserted into and removed from the compartment, said opening being further defined by a pair of end walls extending between said side walls, one of said end walls being located closer to said toe end of said body than said heel end of said body, said one end wall having a substantially U-shaped opening formed therein; and magnetic means in the bottom wall for holding the club head cover on the club head when the club head is contained in the compartment, the magnetic means including two magnets with one magnet located adjacent the body heel end and the other magnet spaced apart from said one magnet in a direction extending toward the body toe end.

2. The golf club head cover of claim 1, wherein the magnets are embedded in the bottom wall.

3. The golf club head cover of claim 1, wherein no other fastening devices are included to prevent the club head cover from being inadvertently removed from the club head.

4. The golf club head cover of claim 1, wherein the magnets are generally cylindrical.

5. The golf club head cover of claim 4, wherein the magnets each have a thickness of about 3 mm and a diameter of about 20 mm.

6. The golf club head cover of claim 4, wherein:

said one magnet has a diameter;

said other magnet has a diameter; and the magnets are spaced apart a distance greater than the diameter of said one magnet and greater than the diameter of said other magnet.

7. The golf club head cover of claim 1, wherein said other magnet is located adjacent the body toe end.

8. A golf club head cover comprising:

a body having an elongated bottom wall, a pair of side walls, a heel end and a toe end, said side walls each lying at a generally right angle to said bottom wall;

the side walls extending from the bottom wall to form a generally L-shaped compartment for containing a golf club head and to define an opening adjacent the body heel end through which the club head may be inserted into and removed from the compartment, said opening being further defined by a pair of end walls extending between said side walls, one of said end walls being located closer to said toe end of said body than said heel end of said body, said one end wall having a substantially U-shaped opening formed therein; and magnetic means in the bottom wall for holding the club head cover on the club head when the club head is contained in the compartment, the magnetic means including two magnets with one magnet located adjacent the body toe end and the other magnet spaced apart from said one magnet in a direction extending toward the body heel end.

9. The golf club head cover of claim 8, wherein the magnets are embedded in the bottom wall.

10. The golf club head cover of claim 8, wherein no other fastening devices are included to prevent the club head cover from being inadvertently removed from the club head.

11. The golf club head cover of claim 8, wherein the magnets are generally cylindrical.

12. The golf club head cover of claim 11, wherein the magnets each have a thickness of about 3 mm and a diameter of about 20 mm.

13. The golf club head cover of claim 8, wherein said other magnet is located adjacent the body heel end.

14. The golf club head cover of claim 11, wherein:

said one magnet has a diameter;

said other magnet has a diameter; and the magnets are spaced apart a distance greater than the diameter of said one magnet and greater than the diameter of said other magnet.

* * * * *

UNITED STATES PATENT AND TRADEMARK OFFICE

CERTIFICATE OF CORRECTION

PATENT NO. : 7,597,126 B2
APPLICATION NO. : 11/193098
DATED : October 6, 2009
INVENTOR(S) : Xiaojian Chen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 497 days.

Signed and Sealed this

Twenty-eighth Day of September, 2010

David J. Kappos

David J. Kappos
*Director of the United States Patent and Trademark Office*